US005706802A

United States Patent [19]

McCormick

[11] Patent Number: 5,706,802

[45] Date of Patent: Jan. 13, 1998

[54] COLD WEATHER BREATHING APPARATUS

[76] Inventor: Bruce McCormick, 16331 Clearcrest, Houston, Tex. 77059

[21] Appl. No.: 736,587

[22] Filed: Oct. 24, 1996

[51] Int. Cl.[6] ..... A62B 7/00

[52] U.S. Cl. ..... 128/204.17; 128/201.13; 128/203.18; 128/207.16

[58] Field of Search ..... 128/204.17, 204.15, 128/201.13, 201.17, 203.16, 203.18, 205.17, 207.16, 205.24

[56] References Cited

U.S. PATENT DOCUMENTS

| | | | |
|---|---|---|---|
| 3,333,585 | 8/1967 | Barghini et al. | 128/201.13 |
| 3,814,094 | 6/1974 | De Angelis et al. | 128/201.13 |
| 3,835,853 | 9/1974 | Turner | 128/201.13 |
| 4,136,691 | 1/1979 | Ebeling et al. | 128/201.13 |
| 4,150,671 | 4/1979 | Tiger . | |
| 4,196,728 | 4/1980 | Granite | 128/201.13 |
| 4,325,365 | 4/1982 | Barbuto | 128/201.13 |
| 4,441,494 | 4/1984 | Montalbaro | 128/204.17 |
| 4,458,679 | 7/1984 | Ward | 128/201.13 |
| 4,461,292 | 7/1984 | Montalbaro | 128/204.17 |
| 4,671,268 | 6/1987 | Hunt | 128/201.13 |
| 4,768,235 | 9/1988 | Webster | 128/204.17 |
| 5,058,211 | 10/1991 | Hanks | 2/206 |

FOREIGN PATENT DOCUMENTS

| | | | |
|---|---|---|---|
| 2237208 | 10/1990 | United Kingdom | A61M 16/00 |
| 0001720 | 5/1984 | WIPO | A61M 16/00 |

*Primary Examiner*—V. Millin
*Assistant Examiner*—V. Srivastava
*Attorney, Agent, or Firm*—Reising, Ethington, Barnard & Perry

[57] ABSTRACT

A breathing device including a heat exchanger module retained adjacent the mouth of a user by a fabric holder. The heat exchanger module includes a wall surrounding a non-linear, tubular flow passage extending between a first air vent and a second air vent. A heat exchanging medium comprising a woven copper cloth is disposed within the flow passage. The flow passage includes a larger cross-sectional area adjacent the first air vent than adjacent the second air vent.

18 Claims, 2 Drawing Sheets

COLD WEATHER BREATHING APPARATUS

TECHNICAL FIELD

The subject invention generally relates to an apparatus for protecting the face of a user from cold weather and for using the heat and humidity from exhaled air to warm and humidify inhaled air.

BACKGROUND OF THE INVENTION

It has long been recognized that, in cold weather conditions, a significant amount of body heat is lost as a result of the inhalation of cold, dry air. This can result in discomfort in milder conditions and be a serious health hazard in arctic or sub-arctic conditions. Prior art devices attempt to solve this problem by using the heat and humidity from exhaled air to warm and humidify inhaled air. For example, U.S. Pat. No. 4,458,679 to Ward and U.S. Pat. No. 4,196,728 to Granite disclose breathing devices including air inlet and outlet ports, a flow path therebetween, and a heat exchanging medium within the flow path for retaining the heat and humidity from exhaled air to warm and humidify inhaled air. Similarly, U.S. Pat. No. 4,150,671 to Tiger discloses a mask including separate and concentric air inlet and outlet passages with heat exchanging fins surrounding the air inlet passage and disposed within the outlet passage for permitting the exchange of heat therebetween. U.S. Pat. No. 5,058,211 to Hanks also discloses a bandanna-type article to be wrapped around the face of a user including a strip of thermally insulative material retained within the bandanna and positioned adjacent the mouth of a user.

The prior art devices, however, are either unwieldy, do not provide for the most efficient use of the heat exchanging medium, or do not provide protection beyond the region immediately adjacent the nose and mouth of a user.

SUMMARY OF THE INVENTION

In accordance with this invention, a breathing device is provided including a heat exchanger module having an outer wall surrounding an interior space. The interior space comprises a tubular flow passage including a first end and a second end. A first air vent is disposed through the wall and is adapted to permit both inflow and outflow of air relative to the first end of the tubular flow passage. A second air vent is disposed through the wall and is adapted to permit both inflow and outflow of air relative to the second end of the tubular flow passage. The tubular flow passage defines a non-linear flow path joining the first and second air vents in fluid communication, and a heat exchanging medium is disposed within the tubular flow passage. A holder supports the heat exchanger module and is adapted to retain the heat exchanger module in a position adjacent the face of a user.

The invention also provides for a breathing device including a heat exchanger module having a wall surrounding an interior space. The interior space comprises a tubular flow passage including a first end and a second end. A first air vent is disposed through the wall and is adapted to permit both inflow and outflow of air relative to the first end of the flow passage, and a second air vent is disposed through the wall and is adapted to permit both inflow and outflow of air relative to the second end of the flow passage. The tubular flow passage defines a flow path joining the first and second air vents in fluid communication, and the tubular flow path includes a cross-sectional area which is larger adjacent the first air vent than adjacent the second air vent. A heat exchanging medium is disposed in the flow passage, and a holder supports the heat exchanger module and is adapted to retain the first air vent of the heat exchanger module in a position adjacent the mouth of a user.

Further, the invention provides for a breathing device including a heat exchanger module and a fabric holder supporting the heat exchanger module. The fabric holder includes an upper peripheral edge and a lower peripheral edge each including a midpoint. The lower peripheral edge includes a low point at the mid-point thereof and slopes upwardly toward the upper peripheral edge along a generally arcuate path to define a lower border for the fabric holder.

By providing a non-linear flow path in the heat exchanger module, a longer flow path can be provided in a relatively compact module. A longer flow path increases the efficiency of the heat exchanger module by forcing longer interaction between air flowing through the flow path and the heat exchanging medium within the flow path. Further, a compact module will only protrude minimally from the face of a user and will be more aesthetically appealing.

By providing a larger cross-sectional area of the tubular flow passage adjacent the first air vent (and consequently, adjacent the mouth of a user), the pressure and velocity of air flowing to and from the mouth of a user is decreased. The heat exchanging medium adjacent the mouth of a user will have the greatest concentration of heat, and the decreased air velocity adjacent the first air vent will cause longer interaction of incoming air with the warmest region of the heat exchanging medium thereby increasing the efficiency of the heat exchanger module.

Finally, by providing a fabric holder having an arcuate, lower peripheral edge, the holder is adapted to cover the lower portion of the face, the front of the neck, the side of the face, and the ears of a user while still retaining the heat exchanger module adjacent the mouth of a user.

DETAILED DESCRIPTION OF THE INVENTION

Figure 1:
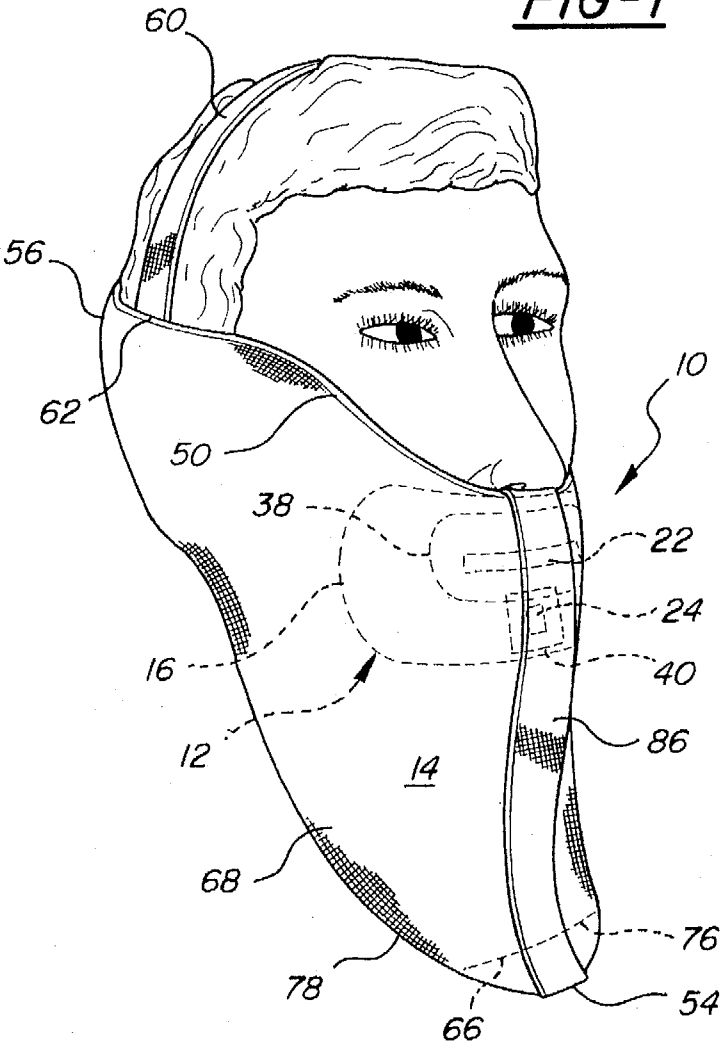
FIG. 1 shows the breathing apparatus of the present invention disposed about the head and face of a user.

The subject invention generally relates to a breathing device 10 for utilizing the heat and humidity from exhaled air to warm and humidify inhaled air. As shown in FIG. 1, the breathing device 10 includes a heat-exchanger module 12 and a fabric holder 14 for supporting the heat-exchanger module 12 adjacent the face and mouth of a user. The heat exchanger module 12 is shown in detail in FIGS. 2–4 and includes an outer wall 16 defining an interior space 17. The outer wall 16 will permit very little detectable pressure loss from the interior space 17 under typical operating temperatures and pressures. The interior space 17 comprises a pair of symmetrical, u-shaped tubular flow passages 26 each including a first end 18 and a second end 20. The first and second ends 18, 20 of the flow passages 26 are immediately adjacent one another and are in fluid communication within the interior space 17. Said another way, the U-shaped flow passages 26 define an oval track providing a continuous path within the heat exchanger module 12.

A first air vent 22 is disposed through the wall 16 immediately adjacent the first ends 18 of the flow passages 26 and is adapted to permit both inflow and outflow of air relative to the first ends 18 of the flow passages 26. Similarly, a second air vent 24 is disposed immediately adjacent the second ends 20 of the flow passages 26 and is adapted to permit both inflow and outflow of air relative to the second ends 20. Although the flow passages 26 in the preferred embodiment are u-shaped, other non-linear configurations that provide a flow passage between the first and second air vents 22, 24 would be acceptable including those that form an arcuate path or a path comprised of numerous linear, multidirectional segments. In addition, the flow passages 26 could comprise a linear path extending in a straight line directly between the first and second air vents 22, 24.

Figure 5:
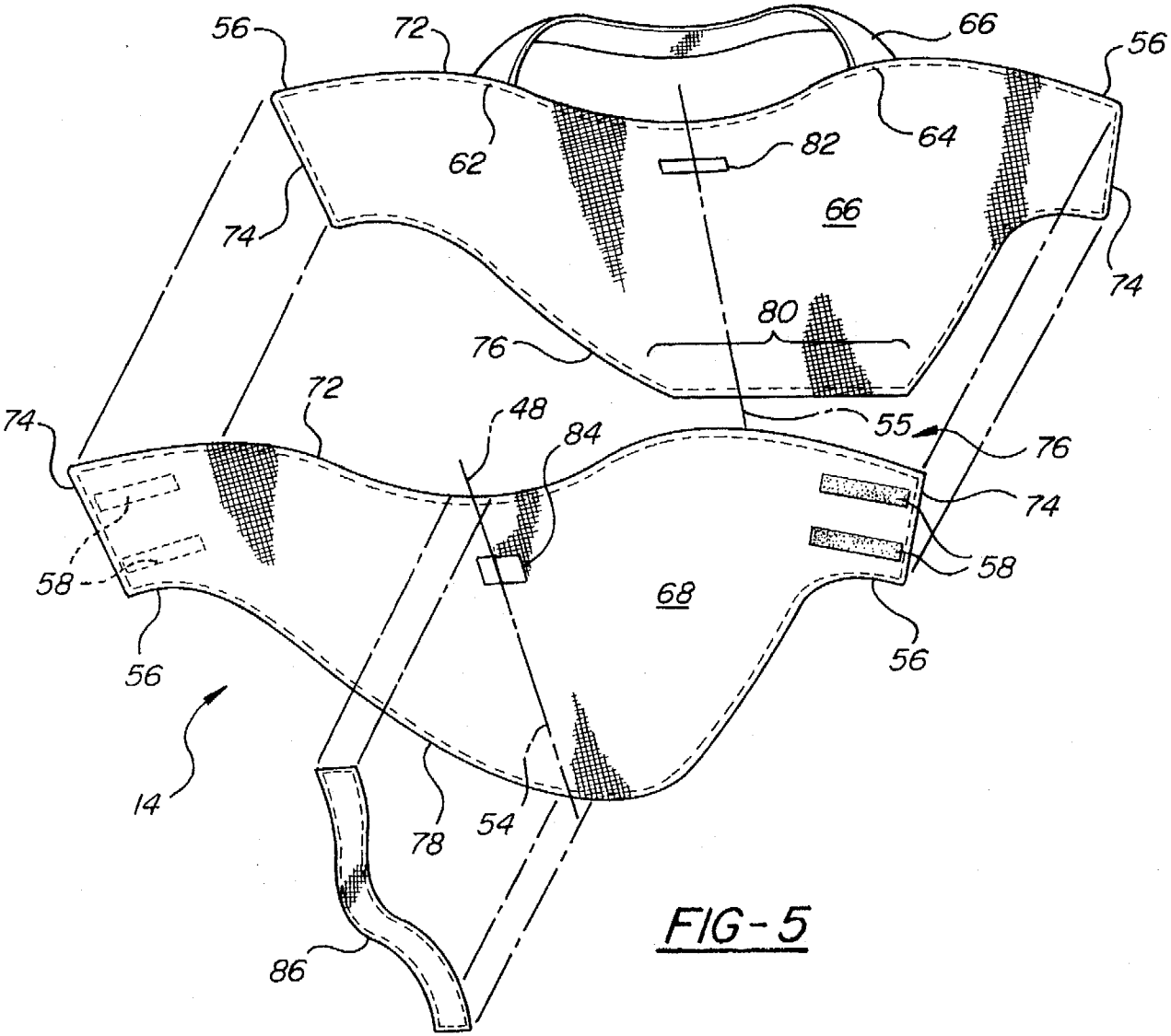
FIG. 5 illustrates an exploded view of the fabric holder for holding the heat exchanger module of the present invention.

As shown in FIG. 5, the fabric holder 14 includes an inner fabric layer 66 and an outer fabric layer 68 defining a pocket 70 therebetween. As shown in FIG. 1, the fabric holder 14 is adapted to cover the lower portion of the face, the front of the neck, the sides of the face, and the ears of a user. The heat exchanger module 12 is shown in phantom and is retained within the pocket 70 and positioned such that the first air vent 22 is disposed adjacent the mouth of a user and the second air vent 24 faces outwardly from the face of a user. The fabric holder 14 will be described in more detail below.

Figure 2:
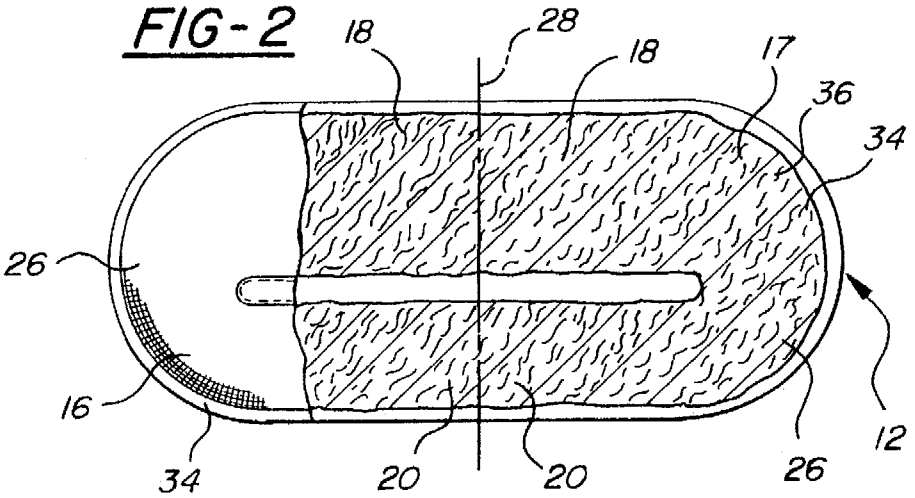
FIG. 2 illustrates a cutaway view of the heat exchanger module of the present invention.
Figure 3:
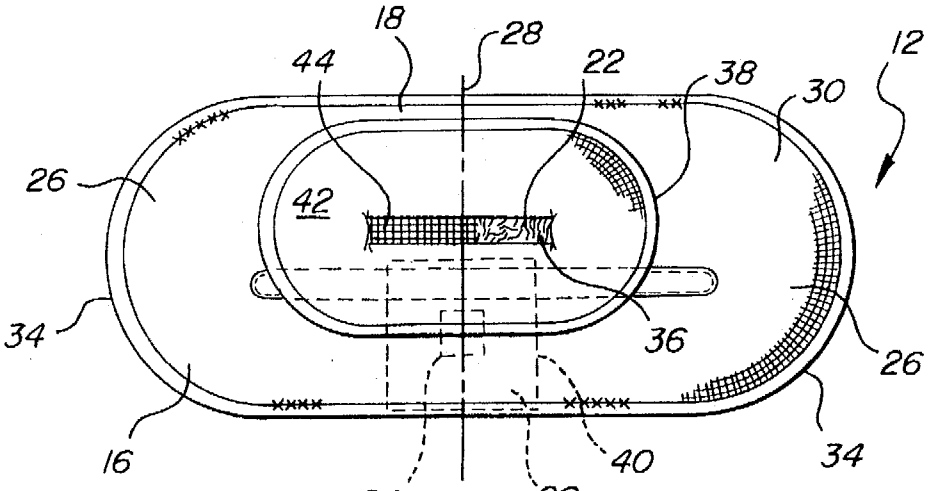
FIG. 3 illustrates a front perspective view of the heat exchanger module of the present invention.
Figure 4:
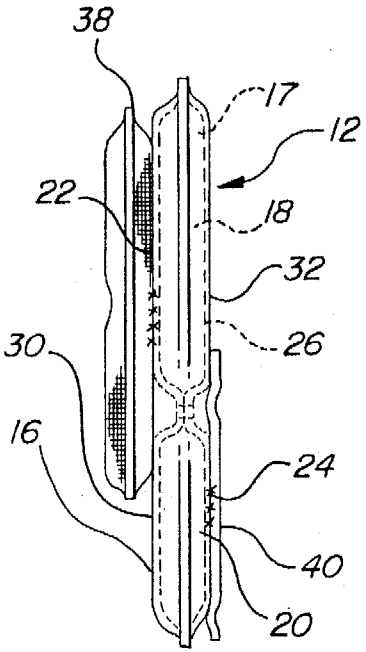
FIG. 4 illustrates a side view of the heat exchanger module.

FIGS. 2-4 illustrate that the heat exchanger module 12 is symmetrical about a vertical axis 28, is oval in shape, and includes a front side 30 to be placed adjacent the face of a user and a rear side 32. The first and second air vents 22, 24 are disposed along the vertical axis of symmetry 28 of the heat exchanger module 12, with the first vent 22 located on the front side 30 and the second vent 24 on the rear side 32. As shown from the side view in FIG. 4, the tubular flow passages 26 are not perfectly cylindrical but have a flattened, oval cross section.

The heat exchanger module 12 includes a heat exchanging medium 36 disposed within the tubular flow passages 26 comprising, in the preferred embodiment, a woven copper cloth. The woven copper cloth is advantageous by providing a uniform dispersion of copper fibers throughout the heat exchanging medium 36. Other heat exchanging media are also well-known in the art and would perform adequately in the present invention.

The non-linear flow passages 26 between the first and second air vents 22, 24 permit the heat-exchanger module 12 to include a longer flow path while remaining relatively compact. For example, an heat exchanger module 12 having a circumference of 18 inches and a length of 8 inches could accommodate a linear flow path 8 inches long or a non-linear, circumferential flow path 18 inches long. The module 12 would have to be elongated considerably to accommodate a linear flow path 18 inches long. A longer flow path increases the relative efficiency of the heat exchanger module 12 by forcing interaction over a longer distance between air flowing through the flow passages 26 and the heat exchanging medium 36 within the flow passages 26. This creates the necessary temperature gradients to result in an efficient energy transfer. A compact heat exchanger module 12 is advantageous by providing a less cumbersome, more cosmetically appealing design which will only minimally protrude from the face of a user.

The flow passages 26 also include a larger cross-sectional area adjacent the first ends 18 than adjacent the second ends 20 by approximately a 2:1 ratio. Because the fabric holder 14 positions the first air vent 22 adjacent the mouth of a user, the larger cross-sectional area of the flow path 26 adjacent the mouth decreases the velocity and pressure of the air adjacent the mouth. Thus, incoming air will interact for a longer period of time with the portion of the heat exchanging medium 36 having the largest concentration of heat, i.e., the portion adjacent the mouth of a user. Said another way, inwardly flowing air will travel at a higher speed adjacent the second air vent 24 furthest from the heat source and at a slower speed adjacent the first air vent 22 closest to the heat source to provide for a more efficient heat exchange. The surface area of the first air vent 22 is larger than the surface area of the second air vent 24 to further enhance this effect.

The heat exchanger module 12 includes first and second outwardly extending flanges 38, 40 surrounding the first and second air vents 22, 24, respectively. As shown best in FIG. 4, the first and second flanges 38, 40 are joined to the outer wall 16 and extend outwardly therefrom to define a ridge or lip surrounding the outer periphery of the first and second air vents 22, 24. As shown in FIG. 3, the first flange 38 adjacent the first air vent 22 can include a soft fabric outer layer 42 to allow comfortable positioning of the flange 38 adjacent the mouth of a user.

To improve the comfort of the heat exchanger module 12, a screen 44 of lightweight nylon mesh is provided over the first air vent 22 to prevent unwanted contact between the lips and tongue of a user with the woven copper cloth of the heat exchanging medium 36. In addition, the outer wall 16 is made from a material which is flexible to permit the heat exchanger module 12 to conform to the shape of the face of a user.

The fabric holder 14 is shown in detail in the exploded view of FIG. 5. The inner and outer fabric layers 66, 68 of the fabric holder 14 are symmetrical about a vertical axis 48 and each include identical upper peripheral edges 72 and side edges 74. The outer layer 68 includes a lower peripheral edge 78 which includes a low point at the mid-point 54 thereof and slopes upwardly toward the upper peripheral edge 72 along a generally arcuate path. The inner layer 66 includes a lower peripheral edge 76 which is substantially identical to the lower peripheral edge 78 of the outer layer 68 with the exception of a region 80 near the mid-point 55 thereof. At this region 80, the lower peripheral edge 76 extends across in a straight, horizontal line such that the inner layer 66 is shorter than the outer layer 68.

The upper peripheral edges 72 and side edges 74 are joined together along the entirety thereof to define the pocket 70 between the inner and outer layers 66, 68. In addition, the lower peripheral edge 76 of the inner layer 66 is joined to the lower peripheral edge 78 of the outer layer 68 along the entirety thereof except along the region 80. The lower peripheral edges 76, 78 are not joined together along this region 80 to provide access to the pocket 70 between the inner and outer fabric layers 66, 68.

The inner fabric layer 68 includes an opening 82 for receiving and retaining the first flange 38 of the heat exchanger module 12. Similarly, the outer fabric layer 66 includes an opening 84 for receiving and retaining the second flange 40 of the heat exchanger module 12. After the flanges 38, 40 are inserted through the openings 82, 84 in the fabric holder 14, the heat exchanger module 12 will be securely retained within the pocket 70 and will have very little, if any, freedom of movement.

The inner and outer fabric layers 66, 68 each include first and second side flaps 56 on opposing sides of each fabric layer 66, 68 which are adapted to wrap around the back of the head of a user and be joined together through suitable attachment means 58. In the preferred embodiment, the attachment means 58 comprises a hook and loop retainer of the type sold under the trade name Velcro, although other means would certainly be equivalent, such as buttons, snaps, interaction caused by a static charge, adhesive, tying, or otherwise entangling the side flaps 56 together. The side flaps 56 extend at a slightly downward angle relative to the fabric panel 46 to further ergonomically adapt the fabric holder 14 to fit about the face and head of a user.

As shown best in FIG. 1, an elastic strap 66 is joined to the fabric holder 14 and includes first and second ends 62, 64 joined to the upper peripheral edges 72 of the inner and outer fabric layers 66, 68. The elastic strap 66 is adapted to fit over the upper portion of the head of a user to prevent downward slippage of the fabric holder 14 away from the face of a user and to permit the fabric holder 14 to retain the heat-exchanger module 12 more securely in position adjacent the mouth of a user.

As an alternative to the elastic strap 66, two separate straps (not shown) could be utilized with each strap including a fixed end joined to the fabric holder 14 and a free end. The two straps would be made from the same material as the fabric holder 14, and the free end of each strap would include mating surfaces of a hook and loop retainer, such as Velcro, to permit the straps to be adjustably joined on top of a user's head. More specifically, the two straps would each include separate inner and outer layers of material integrally formed with the inner and outer fabric layers 66, 68 of the fabric holder 14. The inner and outer layers of the each strap would be joined together into a single member at the same time the inner and outer fabric layers 66, 68 are joined together to form the fabric holder 14.

A vertical strip of fabric 86 is disposed on the outer fabric layer 68 along the vertical axis of symmetry 48 and extends from the upper peripheral edge 72 to the lower peripheral edge 78. The vertical strip of fabric 86 covers the second flange 40 of the heat exchanger module 12 which extends outwardly from the opening 84 in the outer fabric layer 68 to cosmetically conceal the heat exchanger module 12 and provide a more attractive appearance to the breathing apparatus 10 of the present invention.

The fabric holder 14 can be made from any material which will provide insulation against cold. Suitable fabrics include cotton, wool, felt, or other synthetic materials.

Although the description of this invention has been given with reference to a particular embodiment, it is not to be construed within a limiting sense. Many variations and modifications will no doubt occur to those skilled in the art. For a definition of the invention, reference is made to the appended claims.

What is claimed is:

1. A breathing device including:

a heat exchanger module;

said heat exchanger module including a wall surrounding an interior space;

said interior space comprising a tubular flow passage including a first end and a second end;

a first air vent disposed through said wall and adapted to permit both inflow and outflow of air relative to said first end of said tubular flow passage;

a second air vent disposed through said wall and adapted to permit both inflow and outflow of air relative to said second end of said tubular flow passage;

said tubular flow passage defining a non-linear flow path joining said first and said second air vents in fluid communication;

a heat exchanging medium disposed within said tubular flow passage; and a holder supporting said heat exchanger module and adapted to retain said heat exchanger module in a position adjacent the face of a user;

whereby said non-linear flow path between said first and said second air vents permits a relatively compact module to include a longer flow path within said interior space, thereby increasing the relative efficiency of said heat exchanger module by forcing longer interaction between air flowing through said flow path and said heat exchanging medium disposed within said flow path.

2. A breathing device as set forth in claim 1 wherein said heat exchanging medium comprises a woven copper cloth.

3. A breathing device as set forth in claim 1 wherein said tubular flow passage defines a u-shaped path between said first air vent and said second air vent.

4. A breathing device as set forth in claim 1 wherein said tubular flow passage includes a cross-sectional area which is larger at said first end of said flow passage than at said second end.

5. A breathing device as set forth in claim 1 including first and second tubular flow passages each joining said first air vent and said second air vent in fluid communication.

6. A breathing device as set forth in claim 1 wherein said first air vent and said second air vent are oriented in opposite directions.

7. A breathing device as set forth in claim 1 wherein said first air vent includes a larger total surface area than said second air vent.

8. A breathing device as set forth in claim 1 wherein said wall is made from a flexible material.

9. A breathing device including:

a heat exchanger module;

said heat exchanger module including a wall surrounding an interior space;

said interior space comprising a tubular flow passage including a first end and a second end;

a first air vent disposed through said wall and adapted to permit both inflow and outflow of air relative to said first end of said tubular flow passage;

a second air vent disposed through said wall and adapted to permit both inflow and outflow of air relative to said second end of said tubular flow passage;

said tubular flow passage defining a flow path joining said first and said second air vents in fluid communication;

said tubular flow passage including a cross-sectional area which is larger adjacent said first air vent than adjacent said second air vent;

a heat exchanging medium disposed within said tubular flow passage; and a holder supporting said heat exchanger module and adapted to retain said first air vent of said heat exchanger module in a position adjacent the mouth of a user;

whereby said larger cross-sectional area of said tubular flow passage adjacent said first air vent decreases the pressure and velocity of air flowing to and from the mouth of a user, forcing longer interaction of incoming air with said heat exchanging medium adjacent the mouth of a user and thereby increasing the efficiency of said heat exchanger module.

10. A breathing device as set forth in claim 9 wherein said first air vent includes a larger total surface area than said second air vent.

11. A breathing device as set forth in claim 9 wherein said heat exchanging medium comprises a woven copper cloth.

12. A breathing device as set forth in claim 9 wherein said tubular flow passage defines a u-shaped path between said first air vent and said second air vent.

13. A breathing device as set forth in claim 9 including first and second tubular flow passages each joining said first air vent and said second air vent in fluid communication.

14. A breathing device as set forth in claim 9 wherein said first air vent and said second air vent are oriented in opposite directions.

15. A breathing device as set forth in claim 9 wherein said wall is made from a flexible material.

16. A breathing device including:

a heat exchanger module;

a fabric holder supporting said heat exchanger module;

said fabric holder including an upper peripheral edge and a lower peripheral edge each including a midpoint;

said fabric holder comprising an outer fabric layer and an inner fabric layer defining pocket therebetween;

said inner fabric layer including a first opening therein and said outer fabric layer including a second opening therein:

said heat exchanger module including a first air vent and a second air vent each including an outwardly extending flange surrounding said vents;

said heat exchanger module being disposed within said pocket between said outer fabric layer and said inner fabric layer;

said flange surrounding said first air vent being disposed through said first opening in said inner fabric layer; and said flange surrounding said second air vent being disposed through said second opening in said outer fabric layer.

17. A breathing device as set forth in claim 16 including first and second side flaps extending from opposing sides of said fabric holder; and attachment means supported on at least one of said side flaps for joining said first and said second side flaps together.

18. A breathing device as set forth in claim 16 including:

an elastic strap including first and second ends;

said first end and said second end being joined to said upper peripheral edge of said fabric holder at locations spaced equally from said midpoint of said upper peripheral edge.

* * * * *